US008001937B2

(12) United States Patent
Lee

(10) Patent No.: US 8,001,937 B2
(45) Date of Patent: Aug. 23, 2011

(54) OIL GALLERY FOR VARIABLE VALVE TIMING APPARATUS OF A CYLINDER HEAD

(75) Inventor: Bong Sang Lee, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 341 days.

(21) Appl. No.: 12/104,761

(22) Filed: Apr. 17, 2008

(65) Prior Publication Data

US 2009/0151680 A1 Jun. 18, 2009

(30) Foreign Application Priority Data

Dec. 14, 2007 (KR) ..... 10-2007-0131624

(51) Int. Cl.
*F01L 1/34* (2006.01)

(52) U.S. Cl. ..... 123/90.17; 123/90.12; 184/6.23

(58) Field of Classification Search ..... 123/90.15, 123/90.17, 90.12, 90.33; 184/6, 6.23; 92/78, 92/79

See application file for complete search history.

(56) References Cited

U.S. PATENT DOCUMENTS 6,024,062 A * 2/2000 Kako et al. ..... 123/90.17
6,026,772 A * 2/2000 Shirabe ..... 123/90.17
6,129,062 A * 10/2000 Koda ..... 123/90.17
6,173,687 B1 * 1/2001 Fukuhara et al. ..... 123/90.17
6,250,265 B1 * 6/2001 Simpson ..... 123/90.17
6,257,184 B1 * 7/2001 Yamagishi et al. ..... 123/90.15
6,289,859 B1 * 9/2001 Fujii et al. ..... 123/90.15
7,165,522 B2 * 1/2007 Malek et al. ..... 123/90.34

FOREIGN PATENT DOCUMENTS

JP 58135309 A * 8/1983
KR 10-2004-0031578 A 4/2004

* cited by examiner

*Primary Examiner* — Thomas E Denion
*Assistant Examiner* — Daniel A Bernstein
(74) *Attorney, Agent, or Firm* — Morgan, Lewis & Bockius LLP

(57) ABSTRACT

An oil gallery for a variable valve timing apparatus of a cylinder head includes an advance oil supply passage that fluidly connects an oil control valve hole and a variable valve timing journal, a retard oil supply passage that fluidly connects the oil control valve hole and the variable valve timing journal, and an oil chamber in at least one of the oil supply passages. The oil chamber may have a slanted ceiling that may slant upward toward an outlet opening of the oil chamber. The uppermost point of the ceiling may be positioned at the oil outlet. The lowermost point of the outlet opening may be above the bottom surface of the oil chamber.

8 Claims, 2 Drawing Sheets

OIL GALLERY FOR VARIABLE VALVE TIMING APPARATUS OF A CYLINDER HEAD

CROSS-REFERENCE TO RELATED APPLICATION

This application claims priority to, and the benefit of, Korean Patent Application No. 10-2007-0131624, filed in the Korean Intellectual Property Office on Dec. 14, 2007, the entire contents of which are incorporated herein by reference.

BACKGROUND OF THE INVENTION (a) Field of the Invention

The present invention relates to an oil gallery for a variable valve timing (VVT) apparatus of a cylinder head.

(b) Description of the Related Art

An internal combustion engine generates power by burning a mixture of air and fuel in a combustion chamber. Intake valves are operated by a camshaft in order to intake the air, and the air is drawn into the combustion chamber while the intake valves are open. In addition, exhaust valves are operated by the camshaft, and exhaust gas is expelled from the combustion chamber while the exhaust valves are open.

Optimal opening/closing timing of the intake and exhaust valves depends on the rotation speed of the engine. Continuously variable valve timing (CVVT) apparatus have therefore been developed. These apparatus allow different valve timing depending on the engine speed.

Typically, a CVVT apparatus is operated by hydraulic pressure generated by a hydraulic pump when the engine is running. Engine oil, which is incompressible, is used to provide the hydraulic pressure.

While oil has many merits, the oil is under very harsh conditions while the engine is running, and characteristics, such as viscosity, of the oil may suffer with increasing oil temperature. Also, aeration tends to occur in the oil while the oil circulates around various parts of the engine.

Since air is compressible, the incompressibility of the oil is compromised when aeration occurs. Precision in the operation of the CVVT apparatus is thus also compromised, since the CVVT apparatus is operated by hydraulic pressure of the oil. For example, a delay may occur in an actual operation of the CVVT apparatus with respect to desired timing, and control responsiveness of the CVVT apparatus may suffer. Either of these is detrimental to the performance of the CVVT apparatus.

The above information disclosed in this Background section is only for enhancement of understanding of the background of the invention and therefore it may contain information that does not form the prior art that is already known in this country to a person of ordinary skill in the art.

SUMMARY OF THE INVENTION

An oil gallery for a variable valve timing apparatus of a cylinder head includes an advance oil supply passage that fluidly connects an oil control valve hole and a variable valve timing journal, a retard oil supply passage that fluidly connects the oil control valve hole and the variable valve timing journal, and an oil chamber in at least one of the oil supply passages.

The oil chamber may have a slanted ceiling that may slant upward toward an outlet opening of the oil chamber. The uppermost point of the ceiling may be positioned at the oil outlet. The lowermost point of the outlet opening may be above the bottom surface of the oil chamber.

Figure 1:
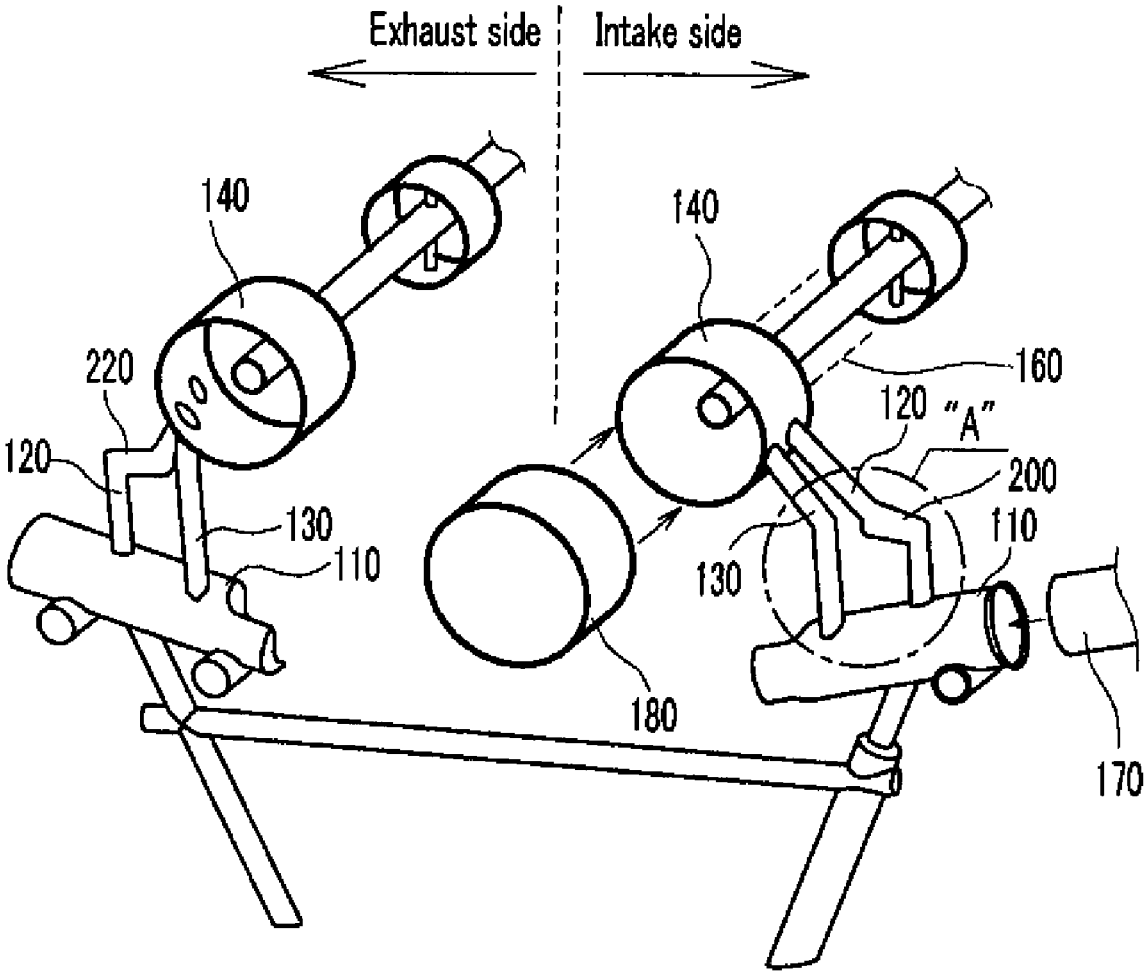
FIG. 1 is a perspective view of an oil gallery according to an exemplary embodiment of the present invention.

| Reference Numerals | |
|---|---|
| 110: | oil control valve hole |
| 120: | advance oil supply passage |
| 125: | uppermost profile of advance oil supply passage |
| 130: | retard oil supply passage |
| 135: | uppermost profile of retard oil supply passage |
| 140: | continuously variable valve timing journal |
| 160: | camshaft |
| 170: | oil control valve |
| 180: | continuously variable valve timing apparatus |
| 200: | oil chamber |
| 210: | ceiling |
| 220: | bottom surface of oil chamber |
| 225: | uppermost point of ceiling |
| 250: | outlet opening |
| 255: | lowermost point of outlet opening |

DETAILED DESCRIPTION OF PREFERRED EMBODIMENTS

An exemplary embodiment of the present invention will hereinafter be described in detail with reference to the accompanying drawings.

FIG. 1 shows an exemplary arrangement of two oil galleries for a continuously variable valve timing (CVVT) apparatus: one at the exhaust side and one at the intake side. The exhaust side and intake side oil galleries may, in some embodiments, be identical. The following description is focused on the intake side (right side in FIG. 1) oil gallery.

A CVVT apparatus 180 is operated by hydraulic pressure from a hydraulic pump (not shown) of an engine. An oil gallery is provided in the cylinder block and the cylinder head to deliver oil from the hydraulic pump to the CVVT apparatus 180. (As is known in the art, an oil gallery is a pipe or passageway in the engine that is used to carry engine oil from one area to another.) An oil control valve (OCV) 170 controls the oil supply to the CVVT apparatus 180.

In more detail, in some embodiments, an advance oil supply passage 120 and a retard oil supply passage 130 fluidly connect an OCV hole 110, in which the OCV 170 is disposed, to a camshaft journal (also called a CVVT journal) 140, to which the CVVT apparatus 180 is mounted.

The CVVT apparatus 180 receives the oil through the CVVT journal 140 from the advance oil supply passage 120 or the retard oil supply passage 130, and then advances or retards an angle of the camshaft 160. This advancement or retardation of the cam angle is controlled by the OCV 170, by selectively supplying the oil through either the advance oil supply passage 120 or the retard oil supply passage 130.

In some embodiments, an oil chamber 200 is provided in one or both of the oil supply passages 120, 130.

Figure 3:
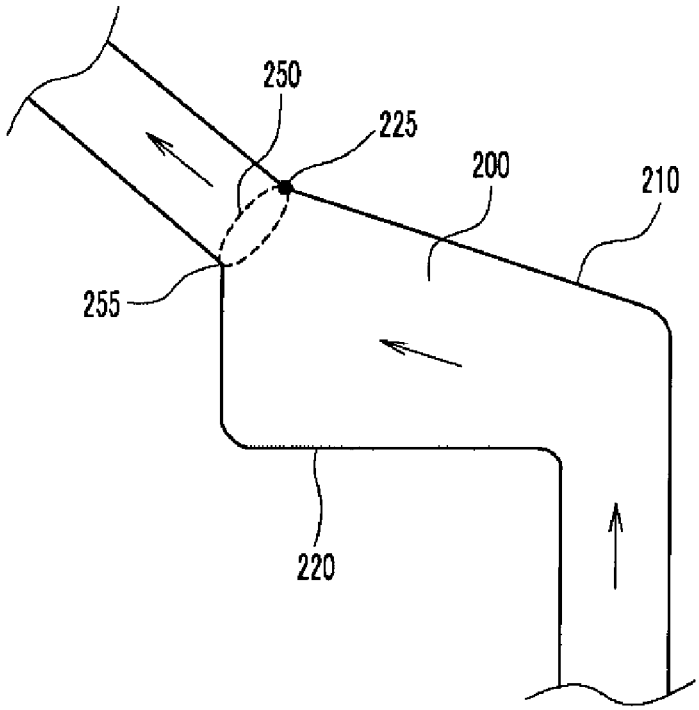
FIG. 3 is a view taken along line III-III of FIG. 2.

As shown in FIG. 3, a ceiling 210 of the oil chamber 200 slants upward toward an outlet opening 250 of the oil chamber 200. Therefore, any air bubbles in the oil chamber 200 rise along the ceiling 210 toward the outlet opening 250.

In some embodiments, the outlet opening 250 includes the uppermost point 225 of the slanted ceiling 210. That is, the ceiling 210 is smoothly connected with the outlet opening 250. By such an arrangement, any air bubbles smoothly exit the oil chamber 200 through the outlet opening 250. In some embodiments, the lowermost point 255 of the outlet opening 250 is higher than the bottom surface 220 of the oil chamber 200.

Figure 2:
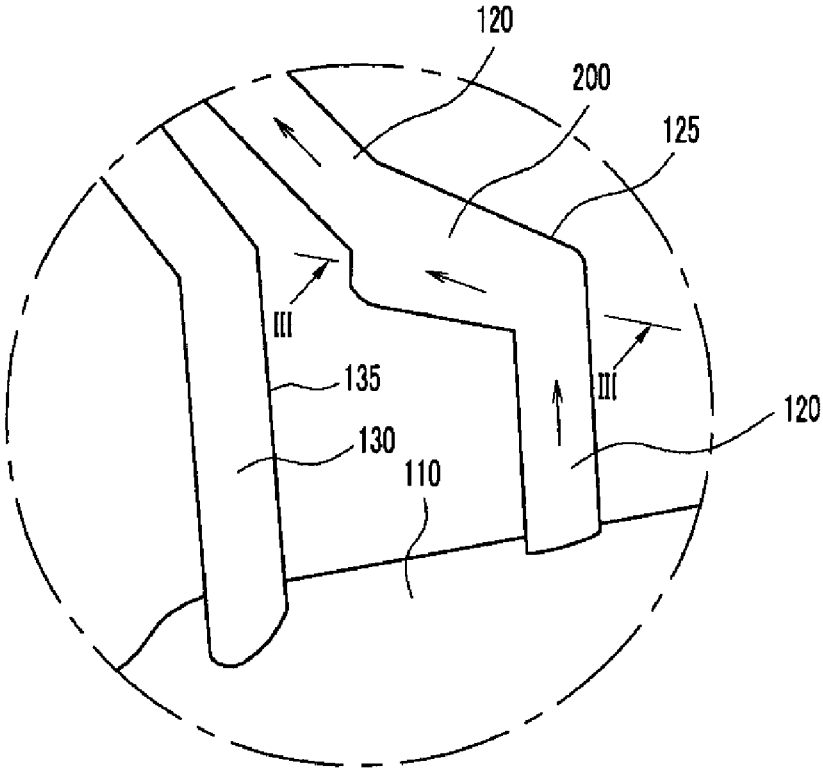
FIG. 2 is an enlarged view of region "A" of FIG. 1.

As shown in FIG. 2, an uppermost profile 125 of the advance oil supply passage 120 and an uppermost profile 135 of the retard oil supply passage 130 monotonically rise from the OCV hole 110 to the CVVT journal 140. Any air bubbles anywhere in the oil gallery may smoothly flow to the CVVT journal 140 through the advance oil supply passage 120 and/or the retard oil supply passage 130. When the air bubble arrives at the CVVT journal 140, the air bubble may be easily exhausted through the CVVT journal 140. Therefore, the oil gallery may be kept free from air bubbles, and thus operate precisely.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. An oil gallery for a variable valve timing apparatus of a cylinder head, comprising:

an advance oil supply passage that fluidly connects an oil control valve hole and a variable valve timing journal;

a retard oil supply passage that fluidly connects the oil control valve hole and the variable valve timing journal; and an oil chamber disposed in at least one of the oil supply passages and remote from the variable valve timing journal;

wherein a cross-section of the oil chamber is larger than a cross-section of the at least one of the oil supply passages.

2. The oil gallery of claim 1, wherein the oil chamber comprises an inlet, an oil outlet, and a slanted ceiling that is inclined upwardly toward the outlet with respect to a horizontal line.

3. The oil gallery of claim 2, wherein the ceiling slants upward toward an outlet opening of the oil chamber from a lower portion of the at least one of the oil supply passages.

4. The oil gallery of claim 3, wherein an uppermost point of the ceiling is disposed at the oil outlet.

5. The oil gallery of claim 3, wherein a lowermost point of the outlet opening is above a bottom surface of the oil chamber.

6. The oil gallery of claim 2, wherein upper and lower portions of the at least one of the oil supply passages are offset in a horizontal direction and the oil chamber is disposed therebetween.

7. The oil gallery of claim 2, wherein an upper portion of the at least one of the oil supply passages is disposed higher than the oil chamber.

8. The oil gallery of claim 7, wherein a lower portion of the at least one of the oil supply passages is disposed lower than the oil chamber.

* * * * *